United States Patent [19]

Prono et al.

[11] Patent Number: 4,507,614

[45] Date of Patent: Mar. 26, 1985

[54] ELECTROSTATIC WIRE FOR STABILIZING A CHARGED PARTICLE BEAM

[75] Inventors: Daniel S. Prono; George J. Caporaso; Richard J. Briggs, all of Livermore, Calif.

[73] Assignee: The United States of America as represented by the United States Department of Energy, Washington, D.C.

[21] Appl. No.: 477,458

[22] Filed: Mar. 21, 1983

[51] Int. Cl.[3] ..... H05H 1/03

[52] U.S. Cl. ..... 328/233; 328/228

[58] Field of Search ..... 328/233, 228

[56] References Cited

U.S. PATENT DOCUMENTS

| | | | |
|---|---|---|---|
| 2,574,655 | 11/1951 | Panofsky et al. | 315/237 |
| 3,206,635 | 9/1965 | Phillips | 328/228 X |
| 3,209,147 | 9/1965 | Dupouy et al. . | |
| 3,912,930 | 10/1975 | Creedon et al. | 250/398 |
| 4,002,912 | 1/1977 | Johnson | 250/396 R |

OTHER PUBLICATIONS

"Accelerating Intense Electron Beams", *Energy & Tech. Rev.,* LLNL, Doc. No. UCRL-52000-79-9, Sep. 1979, pp. 16-24.

"The Advanced Test Accel: A High Current Inducting Linac", LLNL, Paper UCRL-88312, by E. G. Cook et al., Nov. 1982.

"Further Theoretical Studies of the Beam Breakup Instability", *Particle Accelerators,* 1979, vol. 9, pp. 213-222.

"Beam Dynamics in the ETA and ATA 10 kA Linear Induction Accel: Observations & Issues", LLNL, Doc. No. UCRL-85650, Mar., 1981.

"Transverse Resistive Wall Instability of a Relativistic Electron Beam", by G. J. Caparaso et al., *Particle Accelerators,* 1980, vol. 11, pp. 71-79.

*Primary Examiner*—Palmer Demeo

*Attorney, Agent, or Firm*—William H. F. Howard; L. E. Carnahan; Judson R. Hightower

[57] ABSTRACT

In combination with a charged particle beam generator and accelerator, apparatus and method are provided for stabilizing a beam of electrically charged particles. A guiding means, disposed within the particle beam, has an electric charge induced upon it by the charged particle beam. Because the sign of the electric charge on the guiding means and the sign of the particle beam are opposite, the particles are attracted toward and cluster around the guiding means to thereby stabilize the particle beam as it travels.

13 Claims, 15 Drawing Figures

CURRENT
1 kA/d
10 ns/d

POSITION
~1/2 cm/d
10 ns/d

ELECTROSTATIC WIRE FOR STABILIZING A CHARGED PARTICLE BEAM

The U.S. Government has rights in this invention pursuant to Contract No. W-7405-ENG-48 between the U.S. Department of Energy and the University of California, for the operation of Lawrence Livermore National Laboratory.

FIELD OF THE INVENTION

The field of this invention relates generally to the stabilizing of accelerated charged particle beams, and more particularly, to the guiding, focusing and damping of the transverse perturbations of an accelerated charged particle beam.

BACKGROUND OF THE INVENTION

Charged particle beam (CPB) accelerators such as electron accelerators are known in the art. An electron accelerator applies a local electric field to a cluster of traveling electrons, accelerating the electrons through the structure. In this way, the electrons continuously or successively acquire energy until their total energy is many times their rest energy, and their velocity is very close to the velocity of light.

At Lawrence Livermore National Laboratory (LLNL), an electron accelerator known as the Experimental Test Accelerator (ETA) has been fabricated and tested. The ETA employs linear magnetic induction to accelerate electrons. The initial voltage pulse is formed by a coaxial Blumlein transmission line that is triggered by a sparked discharge from an energy storage and charging network. In the first of four sections of the ETA, the electron beam pulse is produced by an electron injector that consists of an anode-cathode and a series of magnetic accelerating units.

This beam pulse, or electron cluster, is fed into the second section, which is a post-accelerator that increases the electron energy up to the final desired value through a series of additional magnetic induction units. In the third section, the beam is then guided by a beam-transport unit into a fourth section, which in the case of the ETA was the experimental tank or test region. A more detailed discussion of the ETA may be found in the article "Accelerating Intense Electron Beams" published in *Energy and Technology Review,* Lawrence Livermore National Laboratory, September 1979, pages 16–24; this article is incorporated by reference into this specification.

The follow-on to the ETA at LLNL is the Advanced Test Accelerator (ATA), which is a linear induction electron accelerator. The already fabricated 200 meter ATA facility has an 85 meter linear accelerator, and consists of four major units: a power conditioning system, a 2.5 MeV electron injector, a 190 module 47.5 MeV accelerator followed by a beam transport pipe, and an experimental tank. The power conditioning system consists of all power supplies, capacitor banks, and pulse conditioning networks which ultimately provide the short, high-voltage pulses that drive the electron injector and accelerator modules. The injector is essentially a 2.5 MeV triode with a hollow anode through which a 10 kA electron beam is injected into the downstream accelerator sections.

The beam is guided magnetically through the accelerator consisting of 190 accelerating cavities (250 kV each). The electron beam, at full energy and still magnetically guided, enters an experimental tank that contains gas of various types and pressures. The accelerator parameters are as follows: 50 MeV, 10 kA, 70 ns pulse width (FWHM), and a 1 kHz repetition rate (rep-rate) during a 10-pulse burst. In addition, beam quality and pulse-to-pulse repeatability must be excellent. The unique features of the ATA are the 10 kA beam and the 1 kHz burst frequency. A more detailed discussion of the ATA may be found in the paper entitled "The Advanced Test Accelerator: A High-Current Induction Linac", LLNL paper UCRL-88312, by E. G. Cook, D. L. Birx and L. L. Reginato, dated Nov. 1, 1982; this paper is incorporated by reference into this specification.

The basic building block of the ATA accelerator is what is variously referred to as the induction unit, or the accelerator cell, or the accelerator cavity. The drive pulse via the two oil-filled cables connects to the metal structure surrounding the 20-inch outside diameter ferrite toroid. The cast epoxy insulator is the oil-vacuum interface, and the electron beam center line is through the center of the cell. Electrically, the cell may be viewed as a 1:1 transformer having a single, very tightly-coupled turn around the ferrite toroids as the primary, and the electron beam as the secondary turn. The accelerating voltage is measured across the one inch gap, while the electron beam sees and gains energy from the axial E-field (electric field) resulting from the flux swing in the ferrite toroids. ATA uses 190 of these induction cells or cavities, bolted together to form its 47.5 MeV accelerator.

Problems and shortcomings, however, exist in the present technology of accelerating charged particle beams. More specifically, charged particle beam (CPB) accelerators have produced high current and high particle energy charged particle beams such as electron beams, but the accelerators are often plagued with difficulties in guiding the beams, and more important, in damping out unwanted beam motion. For example, in a linear induction accelerator (often referred to as a "linac") where numerous accelerating cavities are used, a cavity mode-beam interaction, commonly referred to as the Beam-Break-Up (BBU) instability impresses transverse oscillations and displacement instablilities on the beam. Also, beams for finite rise and fall times present a time varying load to the accelerating induction cores of the cavities; this time varying load causes beam energy to vary slightly during the beam pulse. When steering magnet coils are used to guide the beam, this energy variation translates into a spatial sweep of the beam head and tail. Electron beam generators that use field emission cathodes are also susceptible to beam centroid movement due to time varying irregularities of the cathode emission surface. For many applications, transverse motion of the beam is an undesirable phenomenon that adversely affects beam propagation.

For a more thorough discussion of the beam dynamics and beam breakup instability, reference can be made to the following three documents, which are incorporated by reference into this specification: (1) "Further Theoretical Studies of the Beam Breakup Instability", *Particle Accelerators,* 1979, Vol. 9, pages 213–222, by V. K. Neil, L. S. Hall and R. K. Cooper; (2) "Transverse Resistive Wall Instability of a Relativistic Electron Beam", *Particle Accelerators,* 1980, Vol. 11, pages 71–79, by G. J. Caporaso, W. A. Barletta, and B. K. Neil; and (3) "Beam Dynamics in the ETA and ATA 10 kA Linear Induction Accelerators: Observations and Issues", LLNL document UCRL-85650, by R. J. Briggs, et al.

Attempts have been made to damp out the transverse motion of the beams, but these attempts have various disadvantages. U.S. Pat. No. 3,912,930, entitled "Electron Beam Focusing System", to Creedon et al. issued Oct. 14, 1975, discloses a wire which is positioned on a beam axis to establish a conducting path and anode from a cathode. From an external power source, voltage and current are applied to the wire, thus creating a circular magnetic field around the wire. The magnetic field concentrates and focuses the electron beam. This technique has the disadvantage of requiring that an external power source be attached to the focusing wire. Also, the asmuthally symmetric magnetic field created by the wire cannot damp the transverse motion of very high energy charged particle beams, such as found in the Advanced Test Accelerator at LLNL.

U.S. Pat. No. 3,209,147, entitled "Electron Lens Spherical Aberration Correcting Device Comprising a Current Carrying Wire Section on the Lens Axis", to Dupouy et al., issued Sept. 28, 1965, discloses an electron lens created by inducing a magnetic field in the vicinity of the wire by flowing a direct current through the wire and external power source. Again, this approach has the disadvantage of requiring the wire to be attached to an external power source, and, in essence relies on magnetic fields produced by the current carring wire.

U.S. Pat. No. 2,574,655, entitled "Apparatus for Focusing High-Energy Particles", to Panofsky et al., issued Nov. 13, 1951, discloses a magnetic lens, but this magnetic lens again does not damp out the transverse motions of a charged particle beam, such as used in the above referenced ATA.

U.S. Pat. No. 4,002,912, entitled "Electrostatic Lens to Focus an Ion Beam to Uniform Density", to Johnson, issued Jan. 11, 1977, discloses a plurality of wires which are at ground potential, and which produce an electrostatic field to redirect the ion particle beam; the ions are positively charged particles. A high voltage anode surrounds the wires. Focusing of the particle beam is accomplished by the potential difference existing between the anode and the wires. However, this design is undesirably complex and directed to deflecting ions rather than focusing them. Furthermore, it is not directed to the damping of transverse motion of a charged particle beam.

Therefore, problems of transverse oscillations of charged particle beams continue to persist, particularly in high energy particle accelerators such as the ATA at LLNL. Additionally, the prior art requires an external power source which is used to energize the focusing, stabilizing and guiding means. Thus, a need exists for an improved apparatus and method for attenuating these transverse oscillations.

OBJECTS AND SUMMARY OF THE INVENTION

Accordingly, in order to resolve the above and other problems of the existing technology, it is a general object of this invention to provide apparatus and method for stabilizing an accelerated charged particle beam.

Another more specific object of this invention is to provide apparatus and method for guiding, focusing and damping of the transverse perturbations occurring in an acelerated charged particle beam.

Another object of this invention is to provide means for stabilizing and focusing an accelerated charged particle beam without requiring to use of an external power source for energizing the stabilizing, guiding and focusing means.

Additional objects, advantages and novel features of the invention will be set forth in part in the description which follows and in part will become apparent to those skilled in the art upon examination of the following, or may be learned by practice of the invention. The objects and advantages of the invention may be realized and attained by means of any instrumentalities and combinations particularly pointed out in the appended claims.

In summary, this invention achieves the above and other objects by providing apparatus and method for stabilizing a beam of electrically charged particles. The particles are propelled and guided to travel in a selected direction. A charged particle beam generator and accelerator having a beam transport pipe generates and accelerates a beam of electrically charged particles. Guiding means, disposed within the particle beam, is comprised of a material upon which an electric charge is induced by the electrically charged particle beam. The induced electric charge on the guiding means has a sign which is opposite to the sign of the electric charge of the particle beam. The now electrically charged guiding means causes the particles to move toward and cluster around the guiding means to stabilize the particle beam as it travels.

To more particularly summarize, a positive line charge is created by suspending a wire such as a highly resistive graphite yarn suspended within a beam vacuum pipe. For an embodiment of this invention, the wire is centered in the pipe and supported by two thin graphite foils separated by a distance of 1.4 meters. A (negatively charged) electron beam injected into the region in which the wire is suspended induces significant positive charge on the yarn. The high electrical resistivity of the yarn limits the rise time L/R (where L is defined as inductance per unit length and R is defined as resistance per unit length) to approximately 2 ns (nanoseconds) so that transient currents in the wire die out quickly. The theory, simulations and experimental results presented in this specification show this simple inventive system to be very effective in damping transverse beam motion and in focusing and guiding intense energy charged particle beams such as electron beams.

Several advantages are offered by this invention which are superior to previous approaches. This invention provides a simple electrostatic focusing technique (as opposed to the more conventional magnetic focusing techniques), that also damps tranverse motion of the charged particle beam. The concept involves using the CPB, such as a negatively charged electron beam, to induce a positive line charge on a wire or filament that is centered on and extends axially down a beam vacuum transport tube or pipe, preferably having a circular cross-section. The highly anharmonic potential of the line charge on the wire causes beam electrons far off the centerline axis to oscillate slower than electrons near the axis, resulting in phase mixing of coherent beam motion.

BRIEF DESCRIPTION OF THE DRAWINGS

The accompanying drawings, which are incorporated into and form a part of the specification, illustrate an embodiment of the invention and, together with the description, serve to explain the principles of the invention. In the drawings.

DETAILED DESCRIPTION OF A PREFERRED EMBODIMENT

Figure 1:
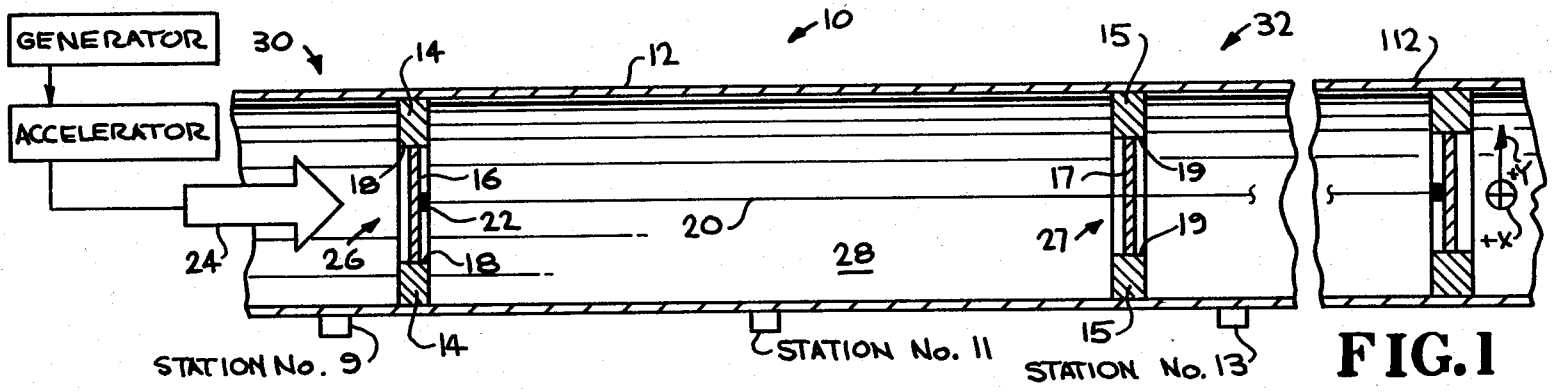
FIG. 1 is a schematic cross-sectional view of a beam transport section in which the guiding means is suspended according to one embodiment of the invention.

Referring now to the drawings, FIG. 1 is a cut away side schematic view according to the invention. This schematic of the charged particle beam transport section 10 comprises a tube or pipe 12. The accelerator pipe 12 can comprise a plurality of what are variously referred to as cells, cavities, or modules (not shown) which are joined together in a linear array. Pipe 12 preferably has a circular cross-section, and internally is held at low vacuum pressure in the range of $10^{-4}$ to $10^{-6}$ torr.

First anchor 14 and second anchor 15 are spaced apart and firmly affixed to the interior surface of pipe 12, and extend inwardly toward the centerline of pipe 12, terminating at first edge 18 and second edge 19, respectively. Anchors 14 and 15 can assume any number of shapes; for example, anchors 14 and 15 could be annular shaped devices, or instead can be a plurality of vanes extending inwardly toward the centerline of pipe 12. Support means such as first foil 16 and second foil 17 are designed to be attached and span the opening defined in annular anchors 14 and 15. First foil 16 is attached across first edge 18 of first anchor 14, and second foil 17 is attached across second edge 19 of second anchor 15.

In this preferred embodiment, the wire 20 guiding means, such as a highly resistive graphite yarn, is attached to first foil 16 with fastener 22, extended along the centerline of pipe 12 through test region 28, passed through an aperture (not shown) provided in second foil 17, to emerge from test region 28 and be secured by a weight (not shown). Alternatively, wire 20 can be firmly attached to second foil 17 at the point where wire 20 penetrates second foil 17, in the same manner as wire 20 is attached to first foil 16 with fastener 22. All components thus far itemized (12, 14, 15, 16, 17, 18, 19, 20, and 22) are all electrically connected so that when no charged particle beam is present, they all are at grounded potential.

Foils 16 and 17 are thin enough, as discussed in the Example below, so that the high energy electron beam passes through them with little degradation of beam parameters (i.e., the beam's current, energy and emittance). Or, the foils could be apertured. Foils 16 and 17 serve only to mechanically support wire 20; the exact means of supporting wire 20 is not crucial to the invention.

Figure 4:
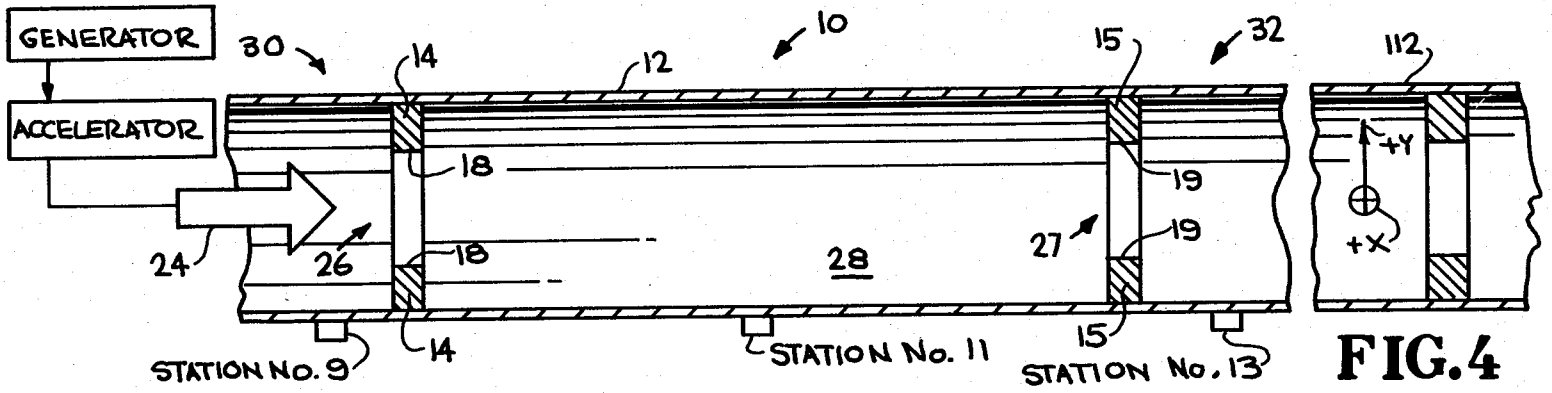
FIG. 4 is the same schematic of the accelerator pipe shown in FIG. 1, with the exception that the wire of the invention has been removed from the beam transport pipe of FIG. 4.
Figure 7:
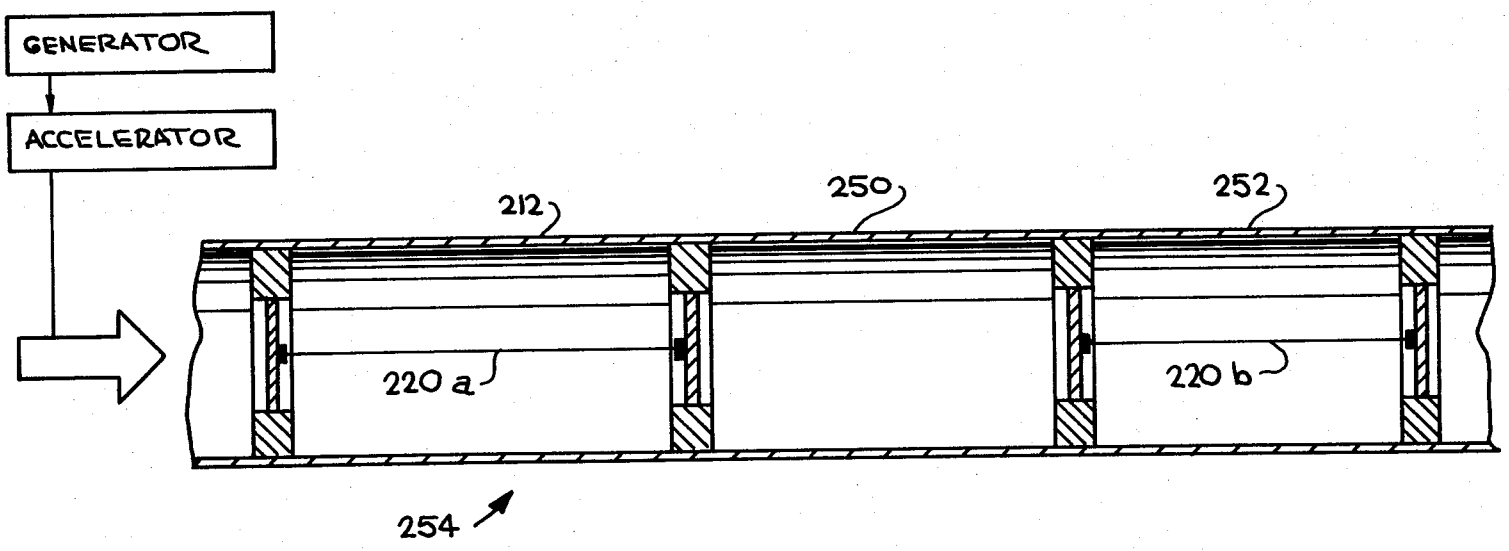
FIG. 7 is a schematic cross-sectional view of a plurality of beam transport sections or modules, in some of which are suspended the guiding means according to one embodiment of the invention.

FIG. 7, along with FIGS. 1 and 4, illustrate that numerous arrangements are possible for the apparatus shown in FIG. 1. For example, a first possible arrangement is to suspend wire 20 throughout the entire length of pipe 12, rather than only in the FIG. 1 test region 28 "module". A second arrangement, illustrated in FIG. 1 and FIG. 4, is to mate a second region 112 to pipe 12 to thereby provide an elongated beam transport pipe; second region 112 lacks the wire 20 of FIG. 1, and can be equivalent to pipe 12 of FIG. 4. This second arrangement, then, essentially provides for joining together the beam transport pipe sections of FIG. 1 and FIG. 4.

FIG. 7 illustrates a third possible arrangement according to the invention, wherein a plurality of individual modules or regions, such as third region 212, fourth region 250, and fifth region 252, are joined to form a series of regions which together function as the beam transport pipe 254. The FIG. 7 arrangement is the equivalent of alternately joining the apparatus shown in FIG. 1 and FIG. 4. In FIG. 7, second wire 220*a* is suspended within third region 212, in a manner identical to wire 20 of FIG. 1; this is also true of third wire 220*b* suspended in fifth region 252. Fourth region 250 lacks the wire guiding means, and is identical to the apparatus shown in FIG. 4. The length of each region can be varied as needed.

During operation, charged particle beam 24, such as an electron (i.e., negatively charged) beam, passes down the centerline of pipe 12, in this case moving from left (i.e., first end 30 of pipe 12) to right (i.e., second end 32 of pipe 12), as shown in FIG. 1. Generally speaking, it is preferable for beam 24 to travel along the centerline of pipe 12; hence wire 20 is likewise positioned at the centerline of pipe 12 since it causes the beam to be focused and guided toward this axis.

Beam 24 passes through first aperture 26 provided in anchor 14 and encounters wire 20. In accordance with electrostatic and electromagnetic theory and practice, beam 24 induces an opposite electric image charge on the interior surface of pipe 12 and on wire 20; i.e., wire 20 now has an electric charge whose sign is opposite to the electric charge sign of the beam 24. Specifically, if beam 24 is an electron beam, then the electric image charge induced on the inside surface of pipe 12 and on wire 20 will have a positive sign. The charged particles (not shown) which in the aggregate create beam 24 are attracted by the opposite electric charge of wire 20. This causes the particles of the charged particle beam 24 to move toward and cluster around wire 20, as beam 24 travels longitudinally along the centerline of pipe 12. The electrostatic charge induced on wire 20 is proportional to the instantaneous beam charge corrected by the inductive lag due to the finite L/R time. To obtain the desirable short duration transient current in wire 20 and inside surface of pipe 12, it is necessary to select wire 20 from materials having high electrical resistance R. Beam 24 then exits test region 28 through second aperture 27 provided in second anchor 15.

Laboratory observation shows that the beam particles of beam 24 orbit in the presence of the anharmonic potential induced on wire 20, thereby giving rise to an energy-dissipationless process known as "phase mix damping". That is, any coherent motion of beam 24 will eventually damp out since the individual beam particles will fall out of phase with one another. This occurs since the orbital frequencies of the particles depend on their distances from wire 20. As this damping occurs, the cross-sectional area occupied by beam 24 in its transverse phase space will increase; the measurement of this cross-sectional area provides what is defined as the "emittance" of beam 24.

Having generally described the apparatus and method of this invention, the following specific example is given to further illustrate one possible construction and use of it.

EXAMPLE

Testing of this invention has been performed in the ETA. As shown in FIG. 1, the experimental tank test region 28 was 1 meter long, 15 centimeters in diameter and evacuated to less than $10^{-5}$ torr base pressure. Measuring instruments or monitors were placed on the outside surface of pipe 12 at Station #9, Station #11 and Station #13 in order to measure the current and position of beam 24 within accelerator pipe 12. The monitor at Station #9 was positioned outside test region 28, a distance of 10 centimeters in front of first aperture 26. The monitor at Station #11 was attached to pipe 12 at a distance of 40 centimeters along the pipe 12 measured from first anchor 14. The distance from the monitor at Station #11 to second anchor 15 at the opposite end of the test region (i.e., at the second end 32 of FIG. 1) was 35 centimeters. First aperture 26 at the entrance to test region 28 was 6 centimeters in diameter and covered by a first foil 16 comprised of a 0.001 inch thick titanium foil. The monitor at Station #13 was placed 10 centimeters beyond second anchor 15 in a direction away from test region 28.

For this experiment, the yarn or wire 20 was passed through the small (i.e., 1 millimeter diameter) supporting graphite cradle or fastener 22 positioned at the center of and attached to the entrance of first foil 16. The other end of wire 20 was kept in tension by passing it through the second foil 17 and then attaching the end of wire 20 to a weight (not shown). Yarn or wire 20 had a diameter of approximately 1.0 millimeters, and consisted of many individual long graphite fibers wound together to form a wire having a continuous and smooth surface. Such a configuration survived several days of testing in the ETA without failure. Beam 24 had a diameter of 1.5 centimeters as it entered first aperture 26. In this case, the ETA produced a beam 24 having a current of 8 kA, a burst duration of 30 ns (i.e., nanoseconds) per beam pulse, a voltage of 4.5 MeV, a beam emittance of approximately 0.15 radian-centimeters, with a 1 pulse-per-second (pps) pulse rate, continuously operated for up to eight hours per day.

The yarn or wire 20 was drawn through a second aperture 27 which was 6 centimeters in diameter but without the second foil 17. Second aperture 27 was located 75 centimeters down stream from first aperture 26. This arrangement tested the invention's capability for focusing beam 24. Diagnostic instruments which monitor the time variation of beam current, as well as displacement of the beam centroid in two vertical planes, were located (1) immediately preceding the entrance foil or first foil 16 (i.e., at Station #9 of FIG. 1), (2) at 40 centimeters downstream from Station #9 (i.e., located at Station #11, and (3) finally at 90 centimeters away from Station #9, (i.e., at Station #13) immediately after the last or second aperture 27.

The dramatic improvement of beam propagation and stability produced by this invention can be readily seen by reference to the drawings. FIG. 4 shows the accelerator beam transport section of FIG. 1, having accelerator pipe 12 but *without* wire 20 of this invention. The FIGS. 5*a* through 5*c* current profiles, and FIGS. 6*a* through 6*c* position profiles were taken at Station #9, Station #11 and Station #13 of the FIG. 4 configuration, in the same location of Station #9, Station #11 and Station #13 of FIG. 1. For the FIG. 1 configuration according to the invention, the current profile shown in FIG. 2*a* through FIG. 2*c*, and the position profile shown in FIGS. 3*a* through 3*c*, are far superior to the current end position profiles found in the FIG. 4 configuration which *lacks* wire 20 of this invention.

Figure 2:
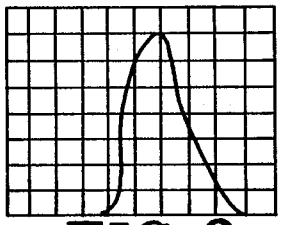
FIG. 2*a* through FIG. 2*c* are graphical representations of the current contained in the charged particle beam respectively at Station #9, Station #11, and Station #13 of the beam transport pipe of FIG. 1.

FIG. 2*a* through FIG. 2*c* and FIG. 3*a* through FIG. 3*c* provide "after" current and beam position profiles measured (i.e., "after" emplacement of wire 20), whereas FIG. 5*a* through FIG. 5*c* and FIG. 6*a* through 6*c* provide "before" current and beam position profiles of particle beam 24 (i.e., "before" insertion of the wire 20 of FIG. 1). All measurements of current and position of beam 24 taken for the FIG. 1 and FIG. 4 apparatus configuration were taken at the same Station #9, Station #11 and Station #13, as beam 16 moves from left to right through pipe 12. In FIG. 4 "before" insertion of wire 20, it can be seen from FIG. 5*a* that beam 24 has a current of 8,000 amps at Station #9; however, by the time beam 24 arrives at Station #13, the current has dropped to a range of approximately 1000–1200 amps. Conversely, FIGS. 2*a*–2*c* show that "after" the addition of wire 20, as shown in FIG. 1, the current curve displayed in FIG. 2*a* (measured at Station #9) drops slightly from 8,000 amps to a range of 7200–7400 amps at both Stations #11 and #13.

Figure 5:
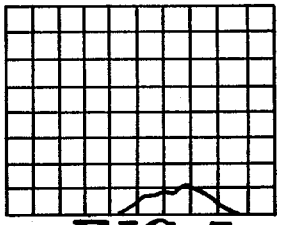
FIGS. 5*a* through 5*c* show graphs of the current in the particle beam taken at Station #9, Station #11, and Station #13 of the beam transport pipe of FIG. 4.
Figure 5:
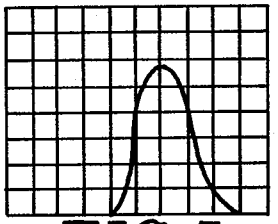
Figure 5:
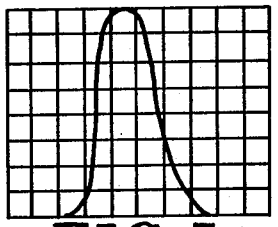
Figure 6:
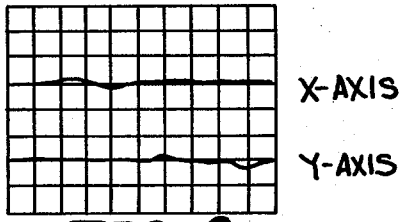
FIGS. 6*a* through 6*c* show the position of the particle beam along the x-axis and y-axis aligned at the accelerator pipe's centerline of FIG. 4.
Figure 6:
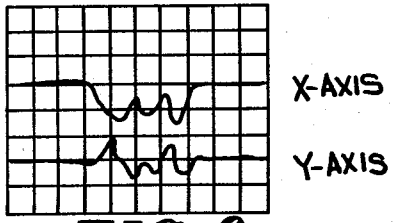
Figure 6:
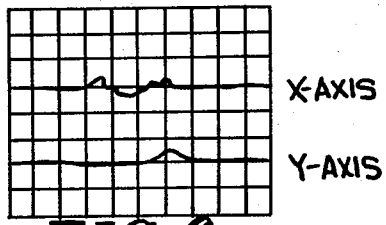

Likewise, FIGS. 6*a*–6*c* show beam position displacement of beam 24 away from the x-axis and y-axis of the centerline of pipe 12. The plus x-axis of pipe 12 for both FIG. 1 and FIG. 4 is into the page; the plus y-axis is vertical on the page as shown. FIGS. 6*a*–6*c* show what happens to beam 24 "before" insertion of wire 20. FIG. 6*a* shows that at Station #9, the beam 24 is not deviating very far from either the x-axis or y-axis. The ideal condition would be no deviation from either the x-axis or y-axis. However, at Station #11, beam 24 significantly displaced off both axes at the same time that the current (as shown in FIG. 5*b* at Station #11) has decreased significantly. Finally, as shown in FIG. 6*c*, beam 24 at Station #13 is even more off-axis since the x-y displacement signal must be normalized to the magnitude of the current (2 G), which has been badly diminished.

Figure 3:
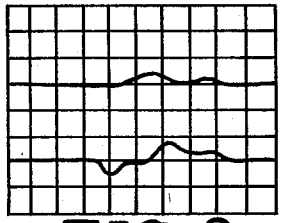
FIG. 3*a* through FIG. 3*c* show the position of the charged particle beam with respect to the x-axis and y-axis of the centerline of the accelerator pipe of FIG. 1. The x-axis is positive going into the page, and the plus y-axis is vertical as shown.
Figure 2:
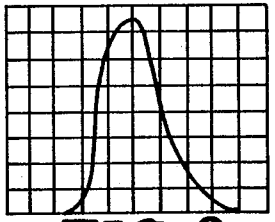
Figure 3:
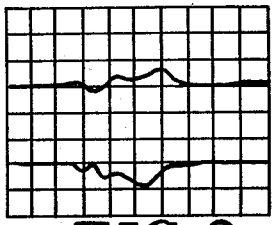
Figure 2:
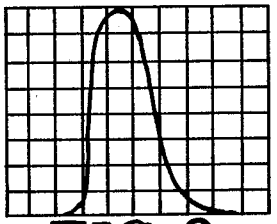
Figure 3:
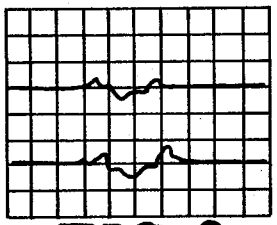

FIG. 2*c* when compared with FIG. 5*c*, and FIG. 3*c* when compared with FIG. 6*c*, dramatically illustrate the benefits which accrue from this invention. The current shown in FIG. 2*c* is much higher than the current shown in FIG. 5*c*. Also, beam 24 as shown in FIG. 3*c* deviates very little from the x-axis and y-axis, while maintaining the high current as shown in FIG. 2*c*. FIG. 6*c* is deceptive in that it appears to indicate a more favorable condition for beam 24 with respect to the axes; however, this occurs because the current as shown in FIG. 5*c* is of such small magnitude.

The spatial dependence of the electric field of wire 20—specifically, the wire 20's strongly anharmonic radial potential—leads to rapid phase mixed damping of a beam that is initially offset from the wire. This damping occurs because the individual particles comprising beam 24 have different orbital periods about wire 20 in the electrostatic field of wire 20. This causes the coherent motion of the beam particles to decay since the particles fall out of phase with each other. The highly anharmonic potential of the line charge on the wire 20 causes beam 24 electrons (not shown) which are far off the centerline axis of pipe 12 to oscillate slower than electrons near the centerline axis, resulting in phase mixing of coherent beam motion. Wire 20 is preferably fabricated from a highly resistive graphite yarn. In a preferred embodiment, the yarn or wire 20 is centered and supported by two thin graphite foils (i.e., foils 16 and 17) separated by a distance of 1.4 meters.

This invention thus greatly enhances the focusing and guiding of charged particle beams, which have in the past been conventionally treated with solenoids or other magnetic focusing elements. The problem of damping transverse beam displacement instabilities has previously been handled with magnetic devices which provide non-linear radial restoring forces. None of these conventional devices provide as strong a damping effect as the wire 20 of the invention. The focusing and guiding ability of wire 20 is also substantially greater than that of practical solenoids. Various schemes have been proposed which would employ channels and low pressure gas to focus and damp the beam. These schemes do not accurately guide the beam and do not provide phase mixed damping that is as efficient as that of wire 20 of this invention. This invention provides strong guiding, focusing, and damping of beam 24 without the need of a gas; the invention operates in vacuum. The construction according to the invention is simple and inexpensive. The invention combines strong focusing, strong guiding, and strong phase mixed damping in a short linear distance.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention, and its practical application to thereby enable others skilled in the art to best utilize the invention in various embodiments, and with various modifications as are suited to the particular use contemplated. It is intended that the scope of the invention be defined by the claims appended hereto.

We claim:

1. In a system including a charged particle beam generator, an accelerator, and a beam transport pipe, apparatus for stabilizing a beam of electrically charged particles which are propelled and guided to travel in a selected direction, said apparatus comprised of:

guiding means, disposed within said beam transport pipe, comprised of a material upon which an electric charge is induced by said electrically charged particle beam, said induced electric charge having a sign which is opposite to the sign of the electric charge of said particle beam, said electrically charged guiding means causing said particles of said particle beam to be electrically attracted to said guiding means, thus causing said particles to move toward and cluster around said guiding means to stabilize said particle beam as it travels.

2. The apparatus according to claim 1, wherein said guiding means is centrally suspended within said beam transport pipe, and wherein said pipe means and said guiding means are in an environment which is at vacuum pressure of less than $10^{-4}$ torr.

3. The apparatus according to claim 1, wherein said guiding means is comprised of highly electrically resistive material having a very small diameter with respect to the particle beam diameter, with the ratio of said guiding means diameter to the particle beam diameter on the order of one-to-ten, said guiding means being centered and axially suspended within said beam transport pipe means.

4. The apparatus according to claim 1, wherein said guiding means is comprised of a plurality of individual graphite fibers wound together to form a wire having a continuous and smooth surface.

5. The apparatus according to claim 1, wherein said guiding means continuously spans a length of the beam transport pipe.

6. The apparatus according to claim 1, wherein said guiding means is segregated into a series of individual modules which abut one another, along at least a portion of the beam transport pipe.

7. The apparatus according to claim 1, wherein said guiding means is segregated into a series of individual modules which are spaced apart from one another and inserted at selected locations of the beam transport pipe.

8. The apparatus according to claim 1, wherein said guiding means is comprised of a filament whose cross-sectional area is small in comparison to the cross-sectional area of the particle beam, such that the cross-sectional area ratio of guiding means to particle beam is in the vicinity of one-to-ten.

9. The apparatus according to claim 1, wherein said induced electric charge is the image charge of the particle beam which is guided, focused, and stabilized against transverse beam motion.

10. The apparatus according to claim 1, wherein said guiding means is electrically grounded.

11. The apparatus according to claim 1, wherein at least a portion of said generator, accelerator means and said guiding means are in an environment which is at vacuum pressure.

12. For use with a charged particle beam generator and accelerator, a method for guiding, focusing and damping transverse oscillations of a moving charged particle beam, comprising the steps of:

(a) disposing at least one guiding means substantially on the longitudinal axis of at least a portion of the particle beam; and (b) inducing with the particle beam an electric charge on the guiding means, which electric charge is opposite in sign to that of said particle beam, said guiding means thus causing said particles to move toward and cluster around said guiding means as said particle beam moves along its direction of travel.

13. The method according to claim 12, wherein the step of inducing an electric charge is carried out by inducing an electrostatic charge on said guiding means.

* * * * *